US007540768B1

(12) United States Patent
Wang

(10) Patent No.: US 7,540,768 B1
(45) Date of Patent: Jun. 2, 2009

(54) ROTATABLE WALL PANEL ASSEMBLY FOR MEDIA SIGNAL WIRE

(76) Inventor: Ying-Cou Wang, 6F, No. 19, Sec. 3, Nanking E. Rd., Taipei (TW)

( * ) Notice: Subject to any disclaimer, the term of this patent is extended or adjusted under 35 U.S.C. 154(b) by 0 days.

(21) Appl. No.: 12/220,138

(22) Filed: Jul. 22, 2008

(51) Int. Cl.
*H01R 13/60* (2006.01)

(52) U.S. Cl. ..... 439/536

(58) Field of Classification Search ..... 439/536–539
See application file for complete search history.

(56) References Cited

U.S. PATENT DOCUMENTS 5,021,009 A * 6/1991 Cox ..... 439/538
5,035,646 A * 7/1991 Ehrenfels et al. ..... 439/536
5,651,696 A * 7/1997 Jennison ..... 439/536
6,083,040 A * 7/2000 Mosquera ..... 439/548
6,544,069 B1 * 4/2003 Enriquez et al. ..... 439/534
6,773,282 B2 * 8/2004 Alvey ..... 439/13
7,412,900 B2 * 8/2008 Santos et al. ..... 73/856
7,415,891 B2 * 8/2008 Santos et al. ..... 73/856

* cited by examiner

*Primary Examiner*—Briggitte R Hammond
(74) *Attorney, Agent, or Firm*—Frenkel & Associates, P.C.

(57) ABSTRACT

A rotatable wall panel assembly for media signal wire has a cover panel, a seat rotationally mounted on cover panel and an A/V connector. The A/V connector is fixed inside the casing, so the A/V connector is rotated relative to the cover panel. Therefore, the installer or user can adjust the position of the front terminal end to match the end of wire or the plug of the electronic device. In addition, the rotatable wall panel assembly in accordance with the present invention has a simple structure and has few necessary elements to decrease assembling time.

20 Claims, 12 Drawing Sheets

ROTATABLE WALL PANEL ASSEMBLY FOR MEDIA SIGNAL WIRE

BACKGROUND OF THE INVENTION

1. Field of the Invention

The present invention relates to a wall panel assembly, and more particularly to a rotatable wall panel assembly that is easily combined with a media signal wire inside the wall.

2. Description of Related Art

Most of users have computers, digital camera devices and/or the audio and video (hereinafter A/V) players in the house so the wires in the house are not limited to power lines, phone lines or cable line etc.

As people daily habits change, wiring for building or house is more and more complex. To prevent wiring from damaging the decoration inside the house or building, the necessary and novel wires, such as twisted pairs, power lines, fiber optical cables, or coaxial cables, are previously embedded in the wall or under the ceiling in the new building.

With reference to FIG. 12, the wall (40) or ceiling of the building has openings (41) where the ends of the wires (42) are exposed. An installer uses wall panel assemblies to cover the corresponding openings (41) on the wall (40). The wall panel assembly has a cover panel (50) and a socket (51) mounted through the cover panel (50). The socket (51) has a front terminal seat (52) and a rear terminal seat (53). When the cover panel (50) covers the corresponding opening (41) on the wall (40), the front terminal seat (52) exposes outside the cover panel (50), and the rear terminal seat (53) is inside the opening (41) and then is connected to the end (421) of the wires (42) in the wall (40). For example, a user can take a coaxial cable to connect between the cable socket of another wall panel assembly and a cable slot on the TV. When the TV turns on, the TV signals from the cable lines in the wall is displayed by the TV. Therefore, the cable lines are embedded in the wall and not damage the decoration inside the house.

Although the cover panel assembly covers the opening on the wall to connect the wires in the opening, sometimes the installer has trouble connecting the end of the wire to the rear terminal seat. Since a wiring direction in the wall is not fixed but the socket is fixed on the cover panel, a length of wire in the opening has to be long enough to connect to the rear terminal seat of the socket. To overcome the shortcomings, the present invention provides a rotatable wall panel assembly for a media signal wire to mitigate or obviate the aforementioned problems.

SUMMARY OF THE INVENTION

The main objective of the present invention is to provide a rotatable wall panel assembly that easily connects to a media signal wire embedded inside a wall.

The rotatable wall panel assembly for a media signal wire has a cover panel, a seat rotationally mounted on cover panel and a media signal connector. The media signal connector is fixed inside the casing, so the media signal connector is rotated relative to the cover panel. Therefore, the installer or user can adjust the position of the front terminal end to match the end of wire or the plug of the electronic device. In addition, the rotatable wall panel assembly in accordance with the present invention has a simple structure and has few necessary elements to decrease assembling time.

Other objectives, advantages and novel features of the invention will become more apparent from the following detailed description when taken in conjunction with the accompanying drawings.

DETAILED DESCRIPTION OF THE INVENTION

Figure 1:
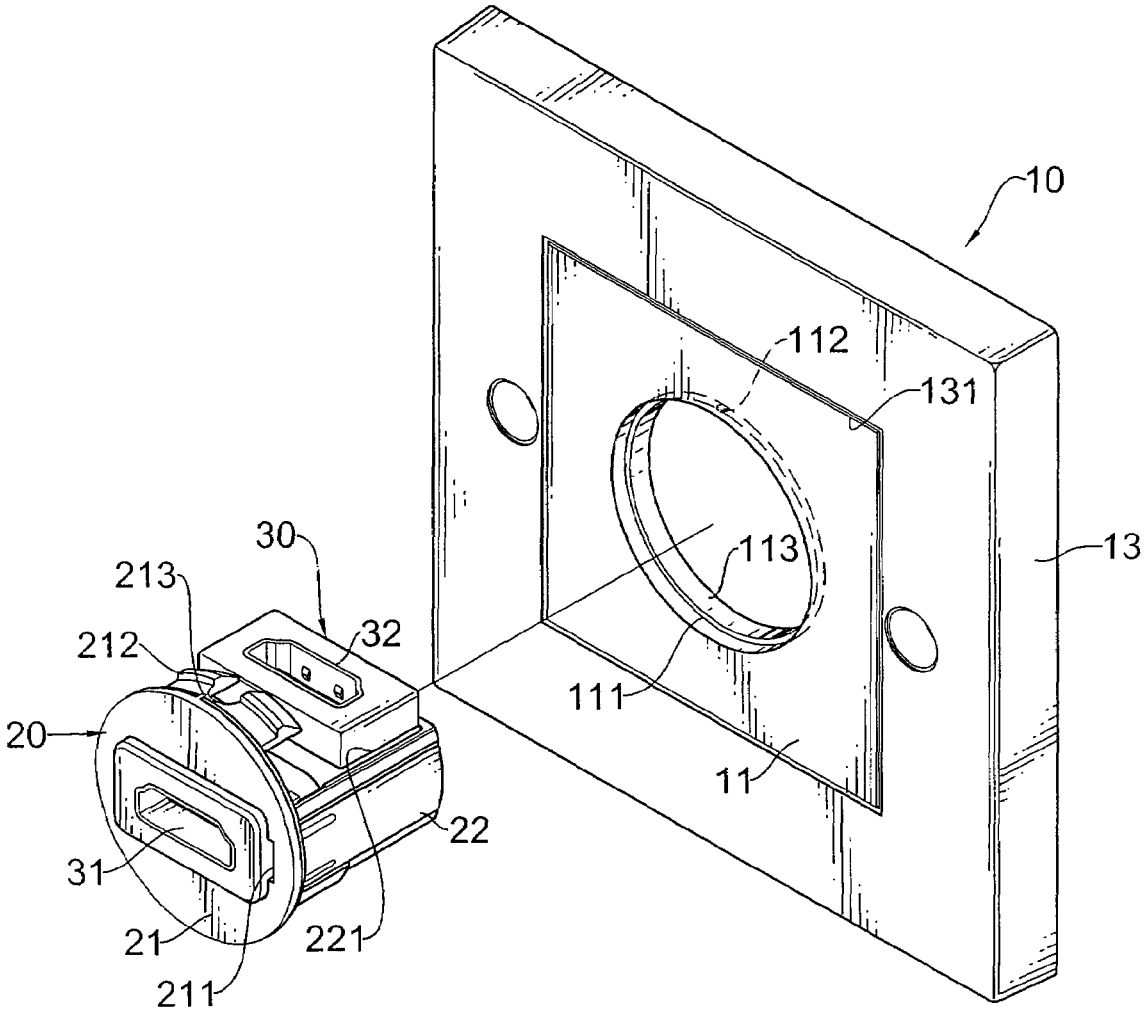
FIG. 1 is an exploded perspective view of a first embodiment of a rotatable wall panel assembly for a media signal wire in accordance with the present invention.
Figure 2:
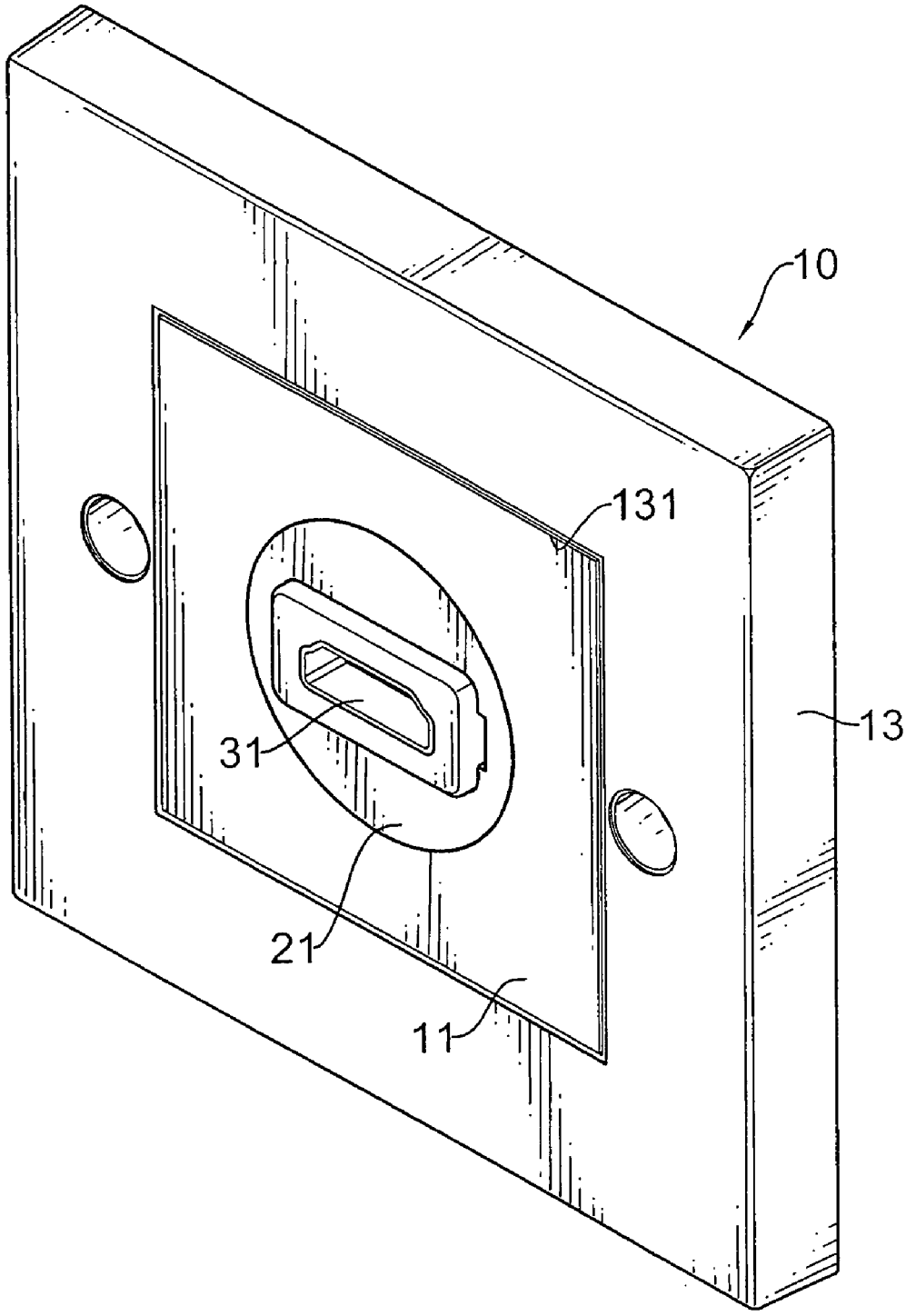
FIG. 2 is a perspective view of the rotatable wall panel assembly in FIG. 1.
Figure 3:
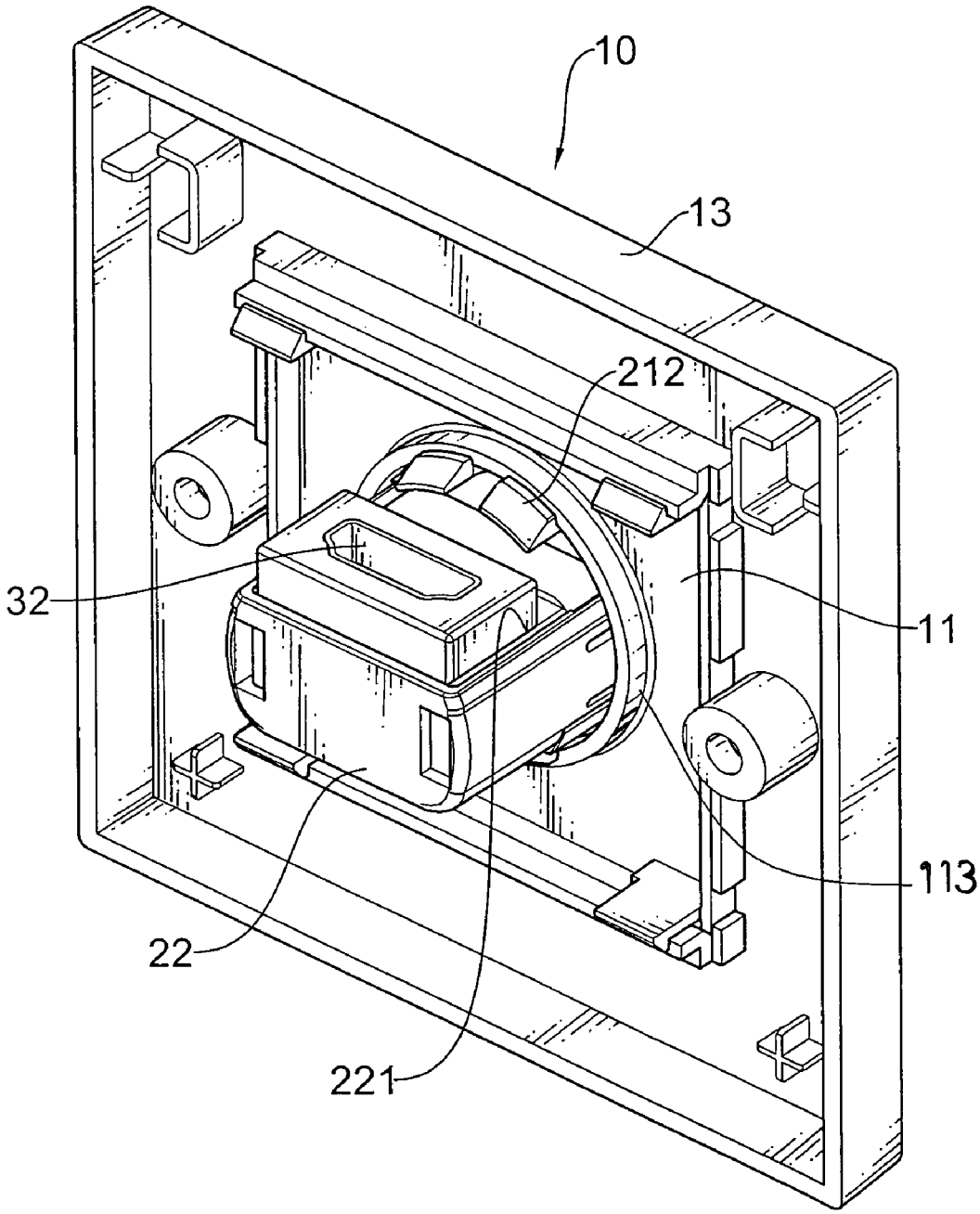
FIG. 3 is another perspective view of the rotatable wall panel assembly in FIG. 1.
Figure 4:
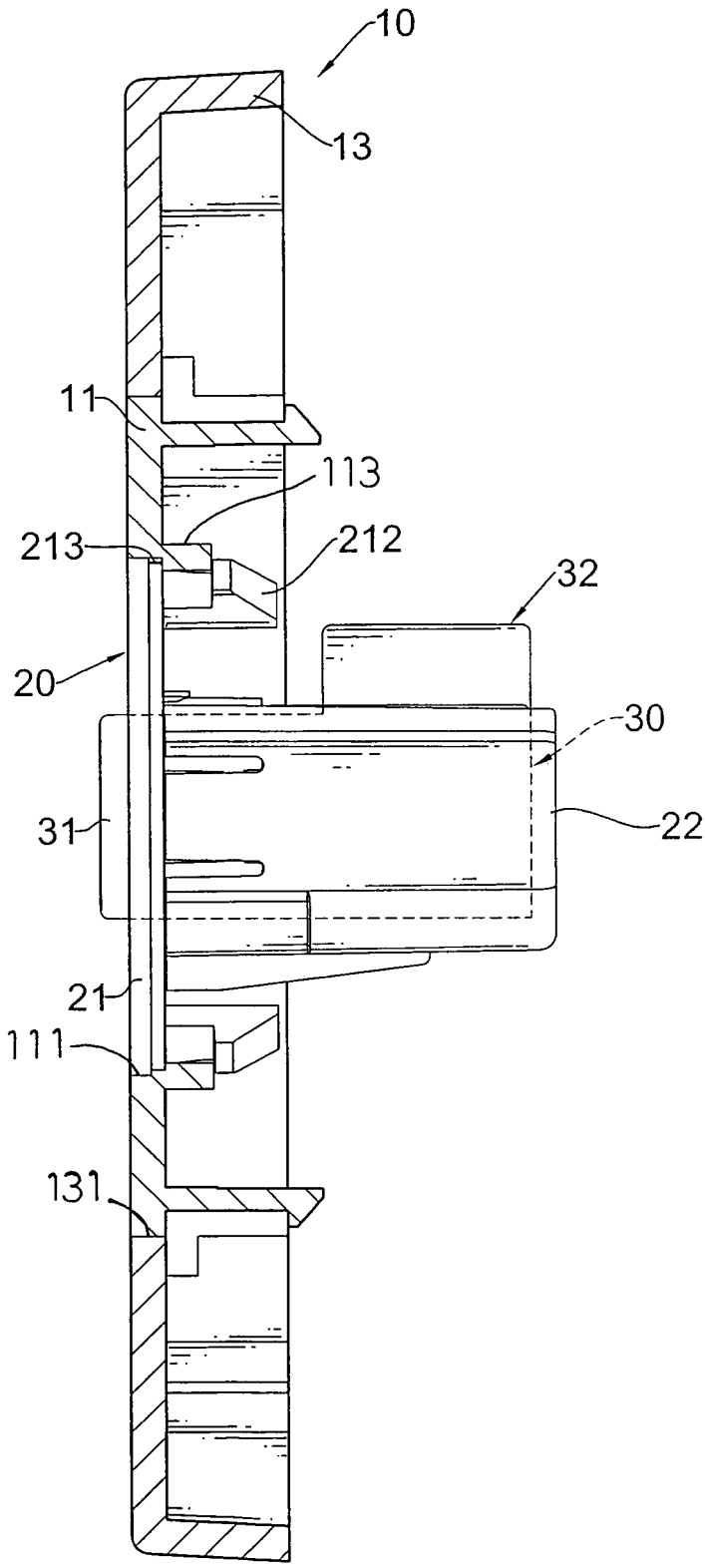
FIG. 4 is a side plan view in partial of the rotatable wall panel assembly in FIG. 1.

The present invention is related to a rotatable wall panel assembly for connecting at least one media signal wire inside the wall. The media signal wire is used to transmit audio signal, video signal or audio and video signal. With reference to FIGS. 1 to 4, a first embodiment of a rotatable wall panel assembly (10) in accordance with the present invention has a cover panel (11), a seat (20), a media signal connector (30) and a decoration panel (13).

The cover panel (11) has a circular hole (111), a ring (113) and a positioning block (112). The circular hole (111) has an inner peripheral. The ring (113) is formed backward from an inner peripheral of the circular hole (111). The ring (113) has a front ring face and a rear ring face. The positioning block (112) is protruded frontward from the front ring face of the ring and on the inner peripheral of the circular hole (111).

The seat (20) is passed through the circular hole (111) of the cover panel (11) and rotationally mounted on the inner peripheral of the circular hole (111). The seat (20) has a circular base (21) and a casing (22). The circular base (21) matches the circular hole (111) of the cover panel (11) and is coplanar with the cover panel (11). The circular base (21) has a front face, a rear face, a side peripheral corresponding to the inner peripheral, a front opening (211) defined through the front face and the rear face, and a stop (213) formed on the side peripheral. Multiple hooks (212) are integrally and backward extended from the rear face of the circular base (21) to hook the rear ring face of the ring (113) and the rear face of the circular base (21) is against the front ring face of the ring (113). When the circular base (21) is mounted rotatably inside the circular hole (111) of the cover panel (11), the stop (213) is selectively against the positioning block (112) to stop (213) the circular base (21) rotating. Since the seat (20) is not rotated over 360 degree, the stop (213) and the positioning block (112) prevent a wire inside an opening of a wall from twisting. The casing (22) is integrally and backward extended from the rear face of the circular base (21) and being around the front opening (211). The case has a side opening (221).

The media signal connector (30) has a front terminal end (31) and a side terminal end (32) and may be integrally formed an L-shaped. The media signal connector (30) is fixed inside the casing (22) of the seat (20). The front terminal end (31) corresponds to the front opening (211) and the side terminal end (32) corresponds to the side opening (221) of the casing (22). Since the seat (20) is mounted rotatably inside the circular hole (111) of the cover panel (11) and the media signal connector (30) is securely mounted inside the seat (20), the media signal connector (30) is rotated relative to the cover panel (11). The front terminal end (31) and the side terminal end (32) may be a high definition multimedia interface (HDMI) terminal, digital visual interface (DVI), VGA interface, or an A/V terminal such as S-Video or composite video. In preferred embodiment, the HDMI terminal end is rectangular, so the front opening (211) of the circuit base is also rectangular.

The decorative panel (13) has a securing hole (131) where the cover panel (11) is mounted.

Figure 5A:
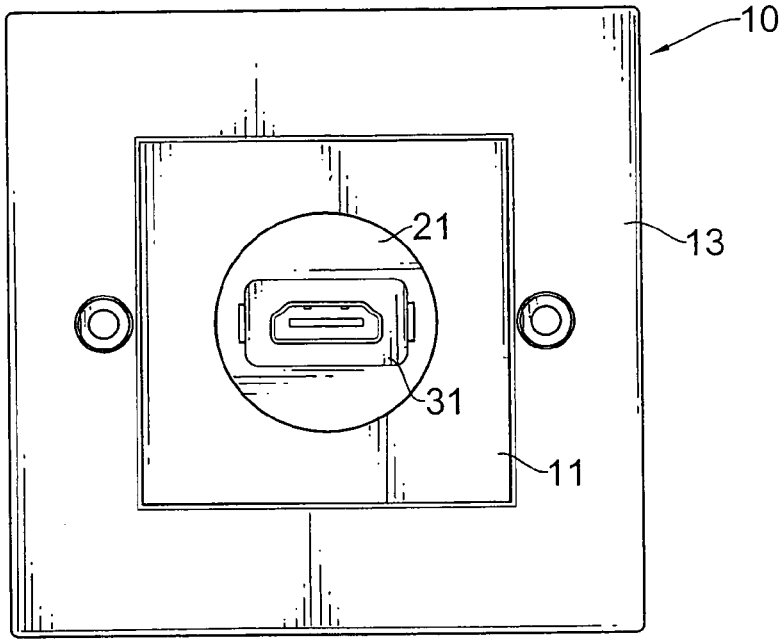
FIGS. 5A and 5B are operational front views of the rotatable wall panel assembly in FIG. 1.
Figure 5B:
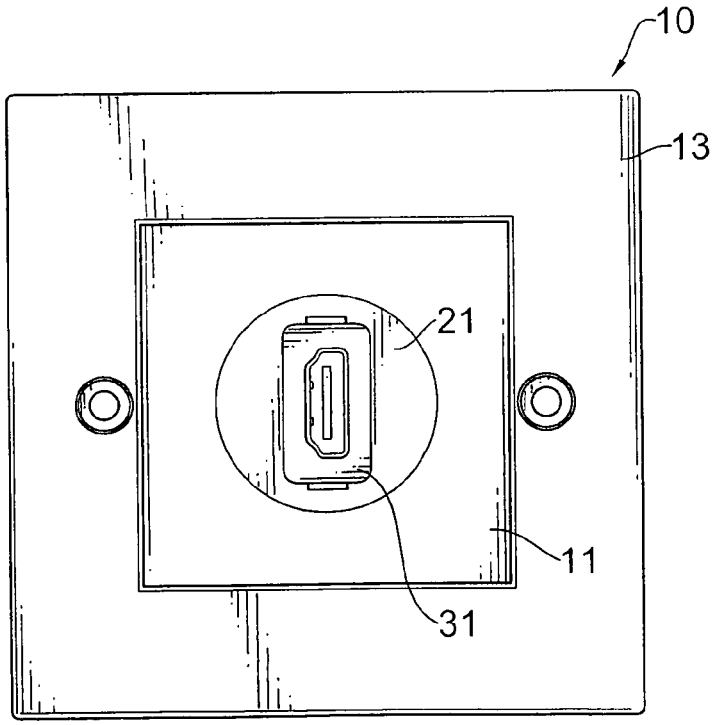
Figure 6A:
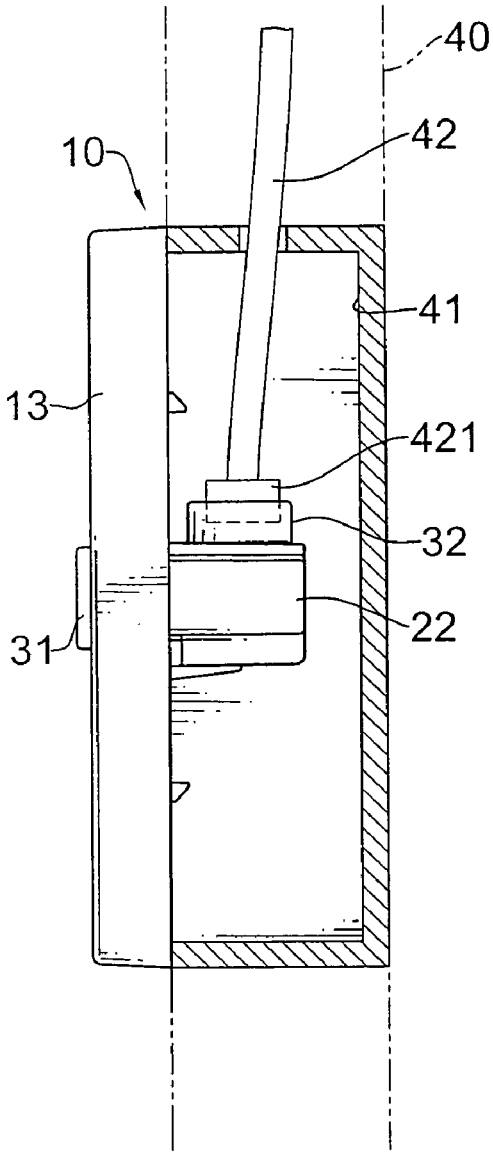
FIGS. 6A and 6B are operational side panel views of the rotatable wall panel assembly in FIG. 1 on a wall.
Figure 6B:
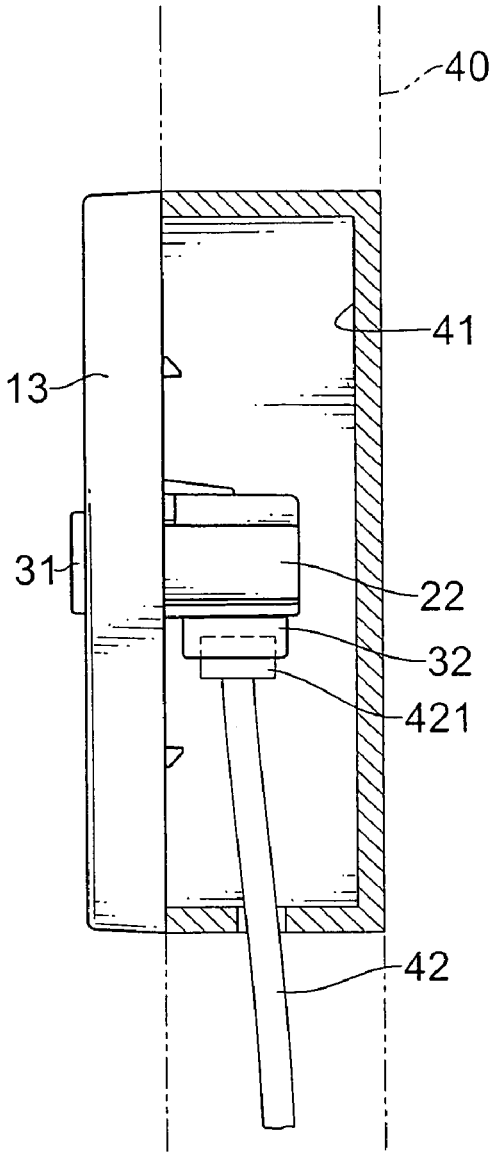

With reference to FIGS. 5A and 5B, the HDMI terminal end (31) is an example. Since the circular base (21) is rotatable, the HDMI terminal end (31) may be in a horizontal position or in a vertical position. Therefore, a user can adjust the position and match an electronic device with a plug of the HDMI terminal. In addition, with reference to FIGS. 6A and 6B, an installer rotates the side terminal end (32) to correspond to an end (421) of the wire (42) in a top side of the opening (41) of the wall (40) or in a bottom side of the opening (41) of the wall (40). Therefore, the rotatable wall panel assembly (10) is easily connected to the ends (421) of the wires (42) embedded in the wall (40).

Figure 7:
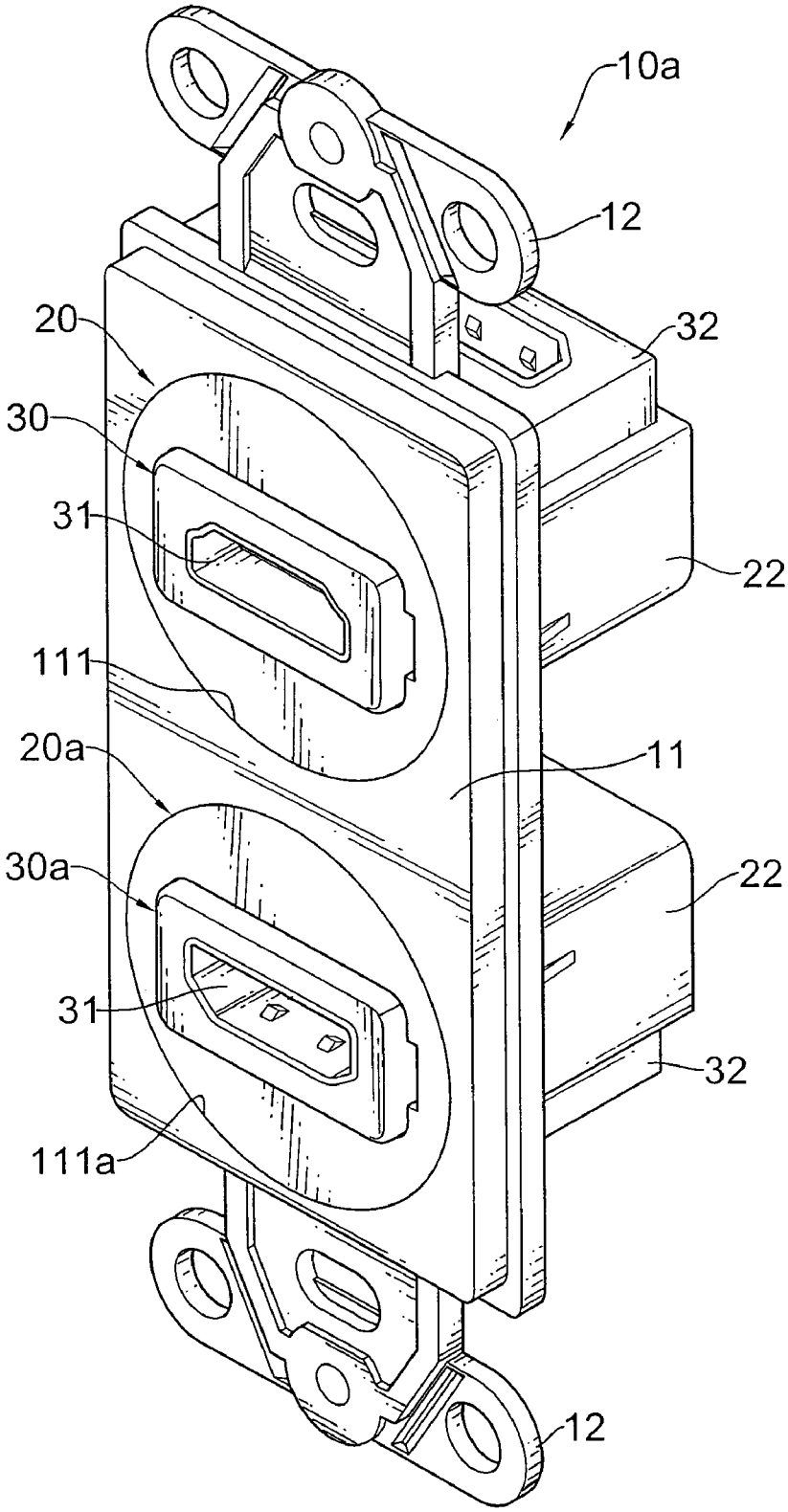
FIG. 7 is a perspective view of a second embodiment of a rotatable wall panel assembly in accordance with the present invention.

With reference to FIG. 7, a second embodiment of a rotatable wall panel assembly (10*a*) in accordance with present invention is similar to the first embodiment and only has two circular holes (111, 111*a*) formed in the cover panel (11), two seats (20, 20*a*) and two media signal connectors (30, 30*a*). Further, the cover panel (11) further has two extending supports (12).

Figure 8:
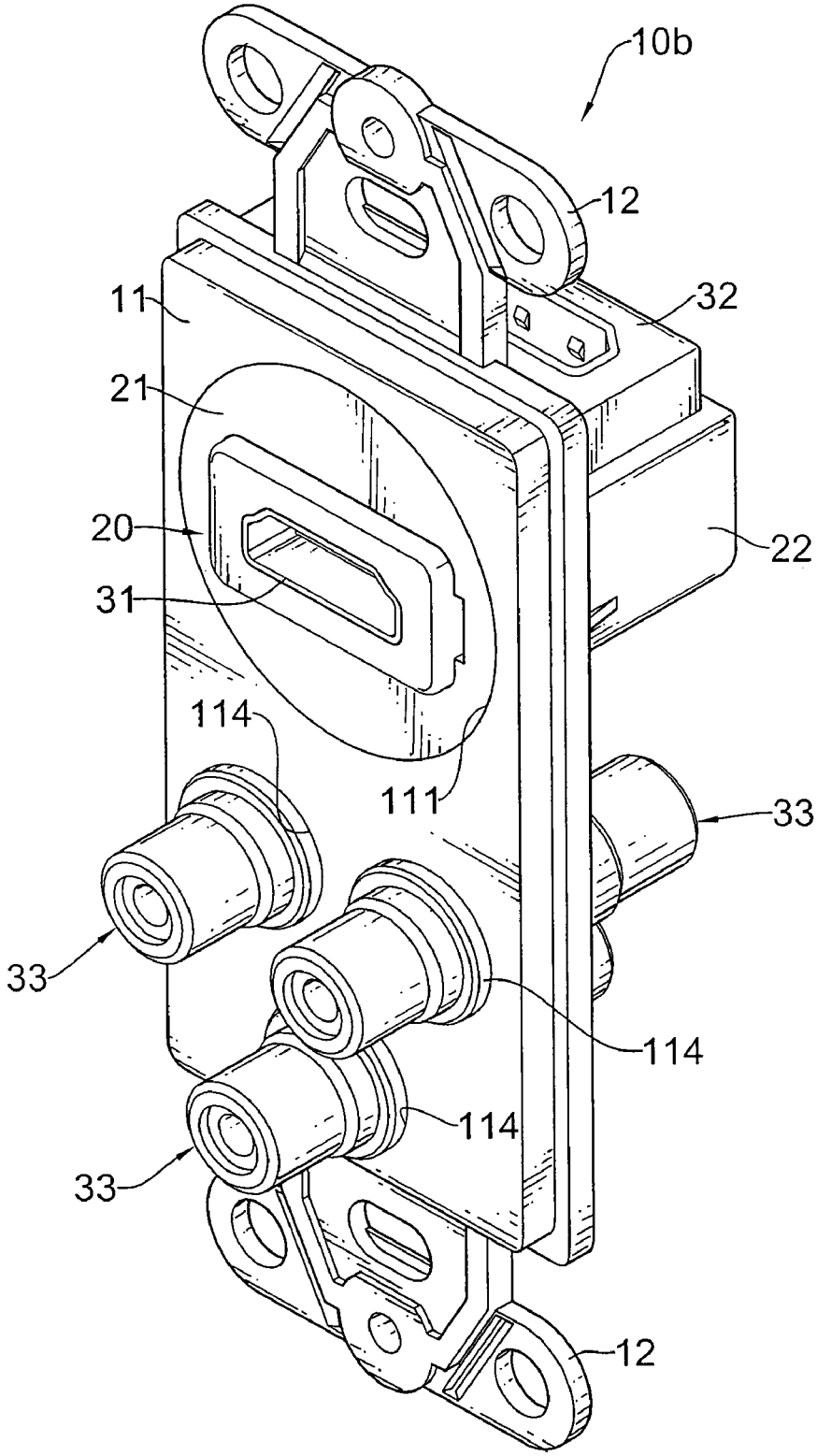
FIG. 8 is a perspective view of a third embodiment of a rotatable wall panel assembly in accordance with the present invention.

With reference to FIG. 8, a third embodiment of a rotatable wall panel assembly (10*b*) in accordance with present invention is similar to the first embodiment. In the third embodiment of the rotatable wall panel assembly (10*b*) further has multiple straight media signal connectors (33), such as component video, that are respectively corresponding to multiple through hole (114) on the cover panel (11). Therefore, multiple media signal connectors (33) are directly and securely mounted through the corresponding through hole (114) of the cover panel (11), and differ from the L-shaped media signal connector (30) of the first embodiment.

Figure 9:
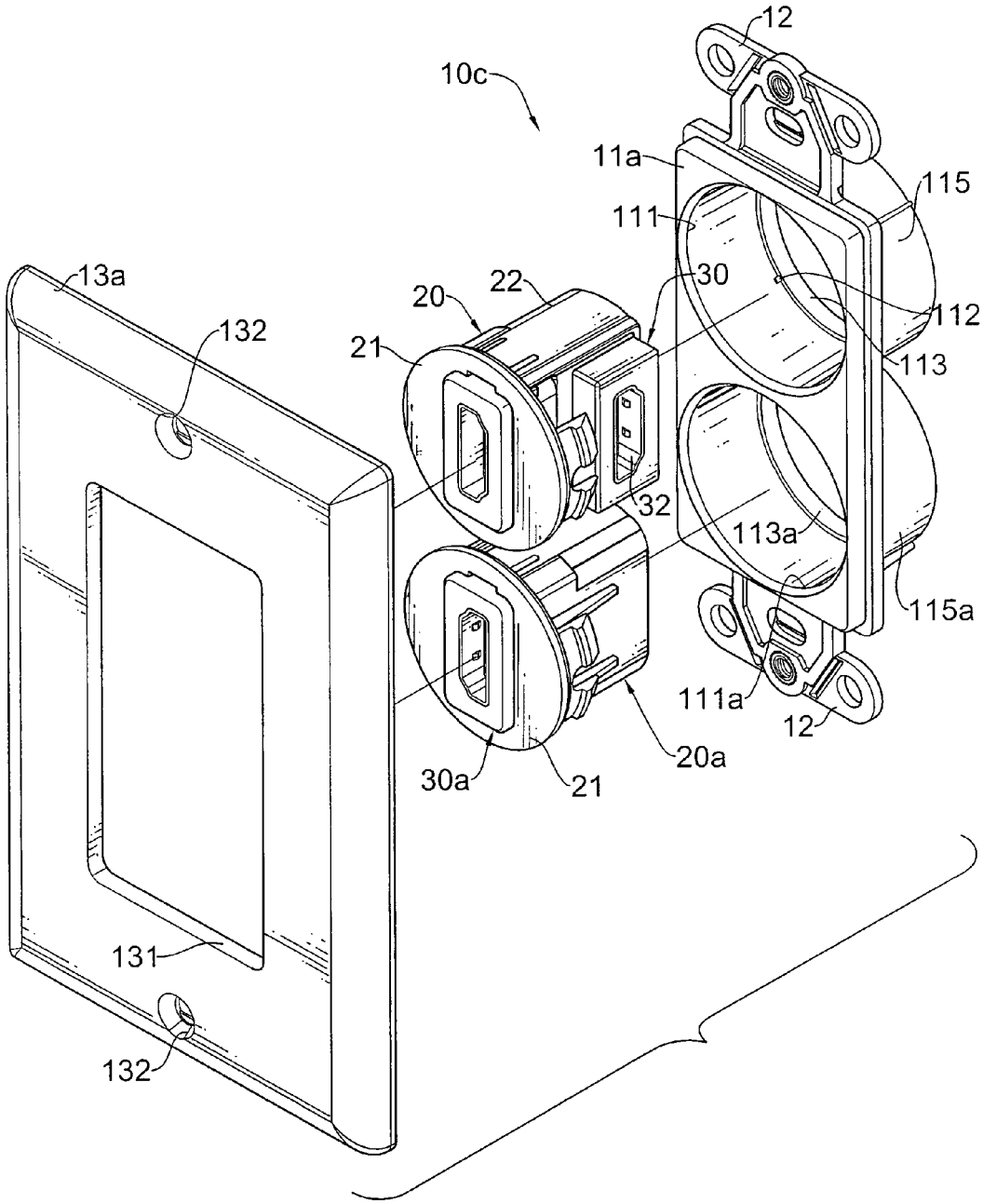
FIG. 9 is an exploded perspective view of a forth embodiment of a rotatable wall panel assembly in accordance with the present invention.
Figure 10:
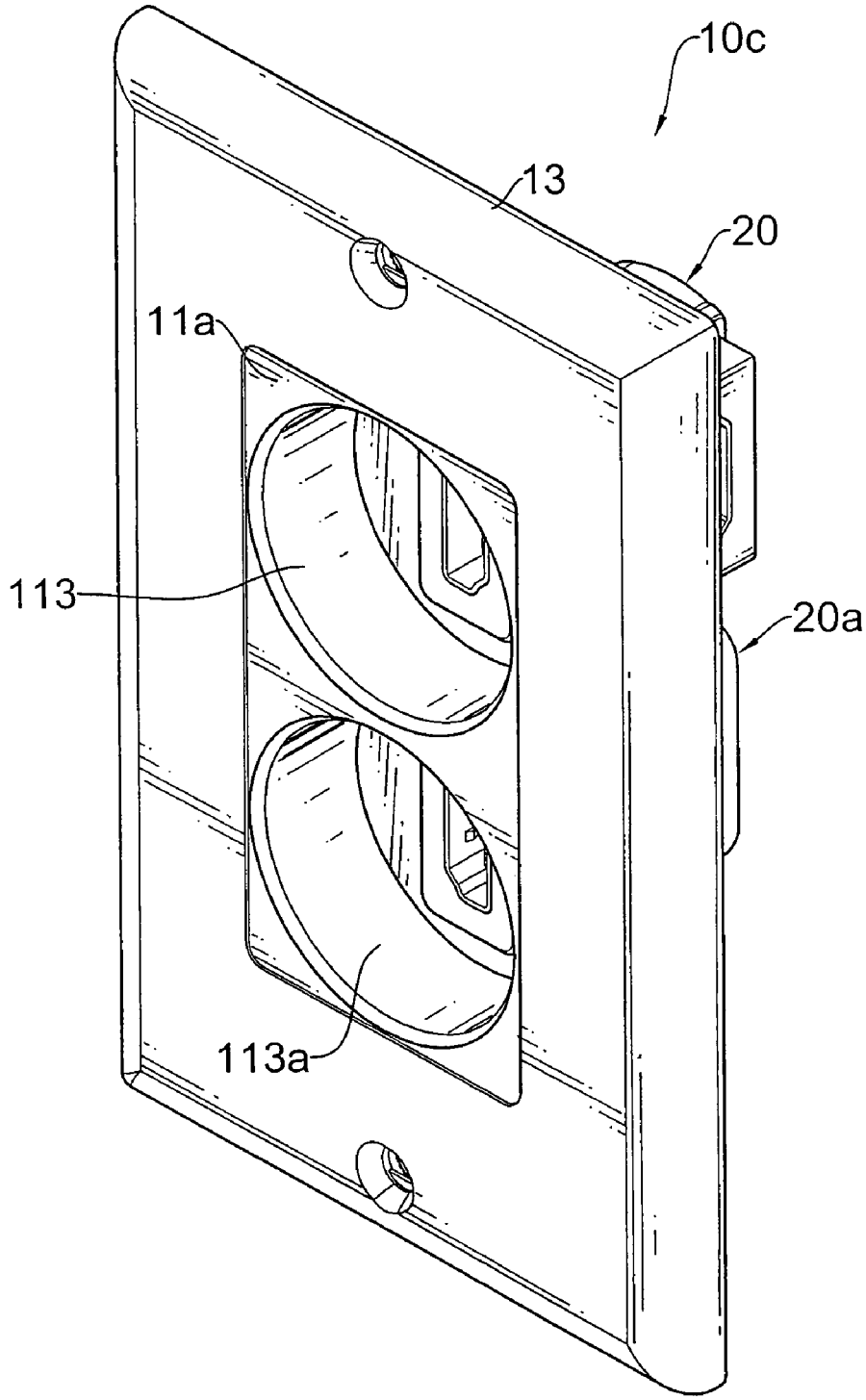
FIG. 10 is a perspective view of the rotatable wall panel assembly in FIG. 9.
Figure 11:
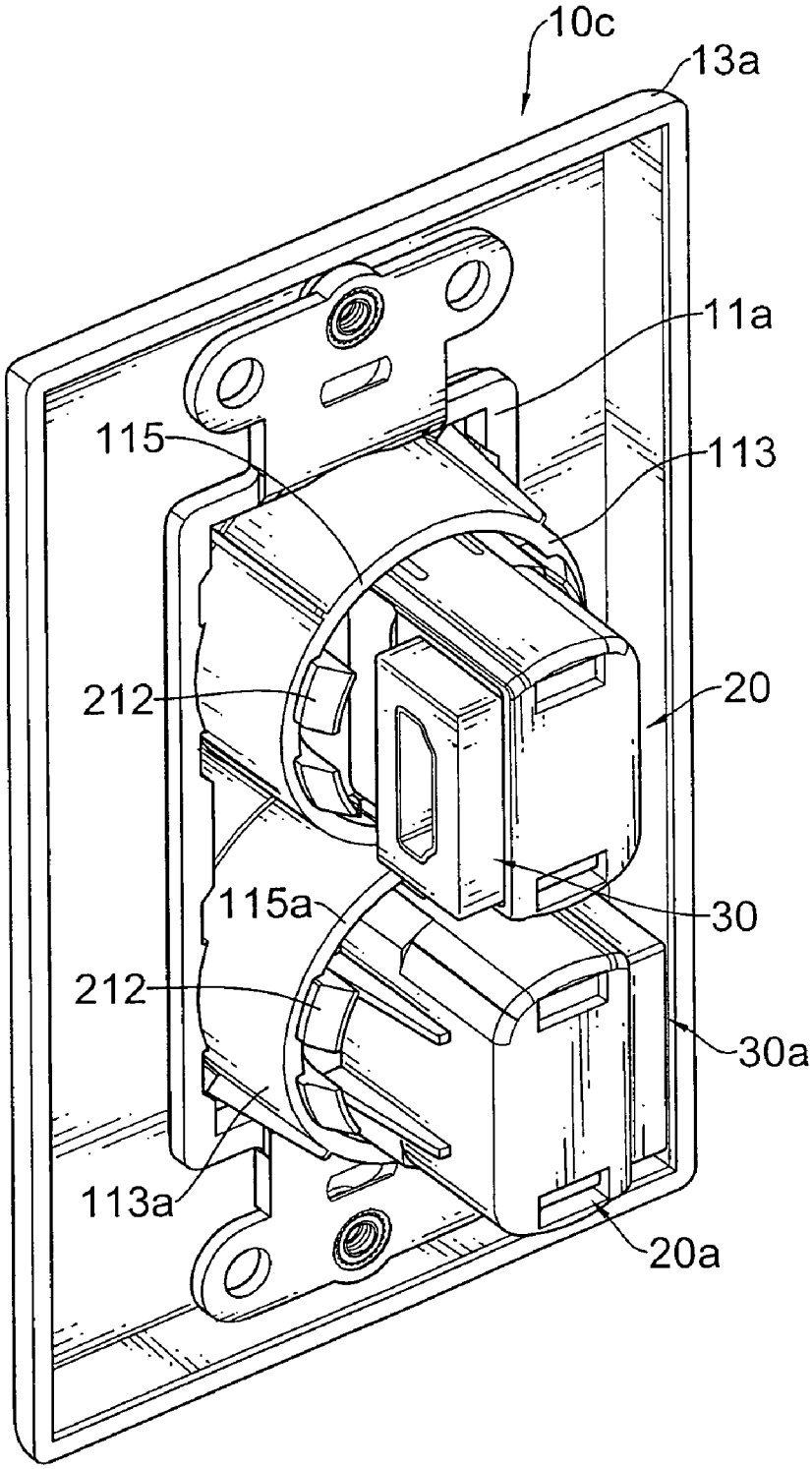
FIG. 11 is another perspective of the rotatable wall panel assembly in FIG. 9.
Figure 12:
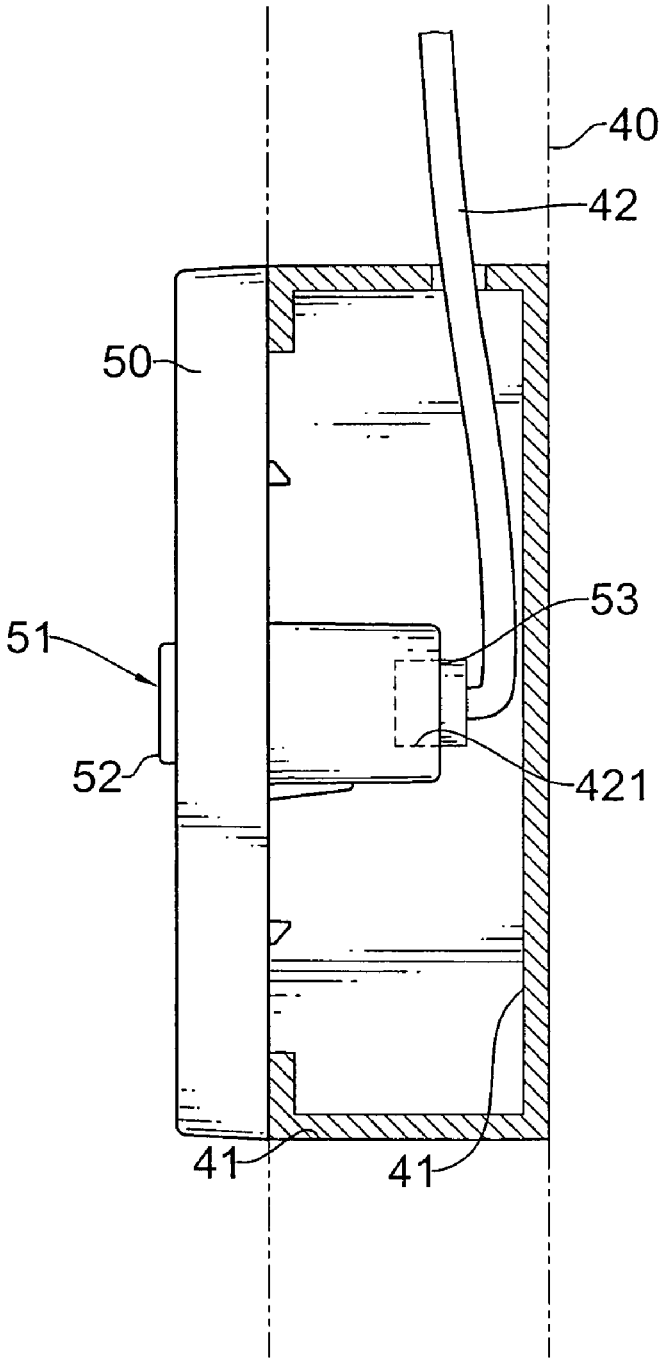
FIG. 12 PRIOR ART
FIG. 12 is a side plane view in partial of a conventional wall panel assembly on the wall in accordance with the prior art.

With reference to FIGS. 9 to 11, a fourth embodiment of a rotatable wall panel assembly (10*c*) in accordance with the present invention has a cover panel (11*a*), two seats (20, 20*a*), two media signal connectors (30, 30*a*) and a decoration panel (13*a*).

The decorative panel (13*a*) has a securing hole (131) and two screw holes (132). The securing hole (131) matches the cover panel (11*a*).

Related to the cover panel (11*a*) of the first embodiment, in this embodiment the cover panel (11*a*) further has two cylinders (115, 115*a*). Each cylinder (115, 115*a*) is integrally and backward extended from the corresponding circular hole (111, 111*a*) and has a rear circular hole. The ring (113, 113*a*) is formed inside the cylinders (115, 115*a*) and closed to the rear circular hole of the corresponding cylinders (114). Each positioning block (112) is also protruded from the front ring face of the corresponding ring (113, 113*a*).

In addition, the cover panel (11) further has two extending supports (12). The extending supports (12) are respectively screws to the corresponding screw holes (132) of the decorative panel (13*a*).

Each seat (20) and each media signal connector (30) are same as that of the first embodiment of the wall panel assembly. The hooks (212) of each seat (20) hook the corresponding rear ring face of the ring (113, 113*a*) and the rear face of each circular base (21) is against the front ring face of the corresponding ring (113, 113*a*). Therefore, the two seats (20, 20*a*) are embedded in the corresponding cylinders (115, 115*a*) and mounted rotatably inside the corresponding cylinders (115, 115*a*). The stop (213) of each circular base (21) is selectively against the positioning block (112) on the front ring face of the corresponding ring (113, 113*a*).

Based on foregoing description, the media signal connector is rotated relative to the cover panel, so the installer or user can adjust the position of the front terminal end to match the end of wire or the plug of the electronic device. In addition, the rotatable wall panel assembly in accordance with the present invention has a simple structure and has few necessary elements to decrease assembling time.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A rotatable wall panel assembly for media signal wire comprising:

a cover panel having:

at least one circular hole having an inner peripheral; and at least ring formed backward from the inner peripheral of the corresponding at least one circular and having a front ring face and a rear ring face;

at least one seat passed through the circular hole of the cover panel, rotationally mounted on the inner peripheral of the circular hole and each of the at least one seat having a circular base matching the circular hole of the cover panel and having a front face;

a rear face being against the front ring face of the corresponding at least one ring;

a side peripheral corresponding to the inner peripheral of the corresponding at least one circular hole of the cover panel;

a front opening defined through the front face and the rear face; and multiple hooks integrally and backward extended from the rear face of the circular base to hook the rear ring face of the ring; and a casing integrally and backward extended from the rear face of the circular base, being around the front opening and having a side opening; and at least one first media signal connector fixed inside the casing of the corresponding at least one seat, and each of the at least one first media signal connector having a front terminal end corresponding to the front opening of the circular base of the corresponding at least one seat; and a side terminal end corresponding to the side opening of the casing of the corresponding at least one seat.

2. The rotatable wall panel assembly as claimed in claim 1, wherein each of the at least one first media signal connector is integrally formed an L-shaped and the seat further comprises at least one cylinder integrally and backward extended from the corresponding at least one circular hole, and each of the at least one cylinder has a rear circular hole, wherein the at least one ring is formed inside the corresponding at least one cylinder and closed to the rear circular hole of the corresponding at least one cylinder.

3. The rotatable wall panel assembly as claimed in claim 1, wherein each of the at least one first media signal connector is integrally formed an L-shaped and the cover panel has two circular holes.

4. The rotatable wall panel assembly as claimed in claim 2, wherein the cover panel has two circular holes.

5. The rotatable wall panel assembly as claimed in claim 1, further comprising at least one second media signal connector securely mounted through the cover panel and being straight and each of the at least one first media signal connector is integrally formed an L-shaped.

6. The rotatable wall panel assembly as claimed in claim 2, further comprising at least one second media signal connector securely mounted through the cover panel and being straight.

7. The rotatable wall panel assembly as claimed in claim 1, wherein each of the at least one first media signal connector is integrally formed an L-shaped;

the cover panel further comprises a positioning block protruded from the front ring face of the corresponding at least one ring and on the inner peripheral of the corresponding at least one circular hole of the cover panel; and the circular base of each of the at least one seat further comprises a stop formed on the side peripheral and being selectively against the positioning block of the corresponding at least one seat.

8. The rotatable wall panel assembly as claimed in claim 2, wherein the cover panel further comprises a positioning block protruded from the front ring face of the corresponding at least one ring and inside the corresponding at least one cylinder of the cover panel; and the circular base of each of the at least one seat further comprises a stop formed on the side peripheral and being selectively against the positioning block of the corresponding at least one seat.

9. The rotatable wall panel assembly as claimed in claim 5, wherein the cover panel further comprises a positioning block protruded from the front ring face of the corresponding at least one ring and on the inner peripheral of the corresponding at least one circular hole of the cover panel; and the circular base of each of the at least one seat further comprises a stop formed on the side peripheral and being selectively against the positioning block of the corresponding at least one seat.

10. The rotatable wall panel assembly as claimed in claim 6, wherein the cover panel further comprises a positioning block protruded from the front ring face of the corresponding at least one ring and inside the corresponding at least one cylinder of the cover panel; and the circular base of each of the at least one seat further comprises a stop formed on the side peripheral and being selectively against the positioning block of the corresponding at least one seat.

11. The rotatable wall panel assembly as claimed in claim 1, further comprising a decorative panel having a securing hole where the cover panel mounted securely and each of the at least one first media signal connector is integrally formed an L-shaped.

12. The rotatable wall panel assembly as claimed in claim 9, wherein the decorative panel further comprises two screw holes;

the cover panel further comprises two supports respectively extended to screw to the corresponding screw holes.

13. The rotatable wall panel assembly as claimed in claim 2, further comprising a decorative panel having a securing hole where the cover panel mounted securely.

14. The rotatable wall panel assembly as claimed in claim 13, wherein the decorative panel further comprises two screw holes;

the cover panel further comprises two supports respectively extended to screw to the corresponding screw holes.

15. The rotatable wall panel assembly as claimed in claim 5, further comprising a decorative panel having a securing hole where the cover panel mounted securely.

16. The rotatable wall panel assembly as claimed in claim 15, wherein the decorative panel further comprises two screw holes;

the cover panel further comprises two supports respectively extended to screw to the corresponding screw holes.

17. The rotatable wall panel assembly as claimed in claim 7, further comprising a decorative panel having a securing hole where the cover panel mounted securely.

18. The rotatable wall panel assembly as claimed in claim 17, wherein the decorative panel further comprises two screw holes;

the cover panel further comprises two supports respectively extended to screw to the corresponding screw holes.

19. The rotatable wall panel assembly as claimed in claim 8, further comprising a decorative panel having a securing hole where the cover panel mounted securely.

20. The rotatable wall panel assembly as claimed in claim 19, wherein the decorative panel further comprises two screw holes;

the cover panel further comprises two supports respectively extended to screw to the corresponding screw holes.

* * * * *